US005483699A

United States Patent [19]

Pernicka et al.

[11] Patent Number: 5,483,699

[45] Date of Patent: Jan. 16, 1996

[54] FACE SHIELD WITH CHIN CONTACTING ELEMENT

[75] Inventors: Martin P. Pernicka, St. Fran.cois; Paul Isabelle; Hubert Gagnon, both of St.-Augustin de Desmaures, Canada

[73] Assignee: Leader Industries, Inc., Boucherville, Canada

[21] Appl. No.: 231,815

[22] Filed: Apr. 25, 1994

[51] Int. Cl.[6] ..... A41D 13/00; A42B 3/20

[52] U.S. Cl. ..... 2/9; 2/424

[58] Field of Search ..... 2/9, 424, 425, 2/15, 10, 422, 421, 410, 411, 8

[56] References Cited

U.S. PATENT DOCUMENTS

| | | | |
|---|---|---|---|
| 1,060,220 | 4/1913 | White | 2/9 |
| 3,113,318 | 12/1963 | Marietta | 2/9 |
| 3,339,207 | 9/1967 | Perry | 2/8 |
| 4,021,858 | 5/1977 | Neeld et al. | 2/9 |
| 4,117,554 | 10/1978 | Palumbo | 2/8 X |
| 4,539,713 | 9/1985 | Hodge | 2/8 |
| 5,249,347 | 10/1993 | Martinitz | 2/424 X |

FOREIGN PATENT DOCUMENTS

| | | | |
|---|---|---|---|
| 1116801 | 1/1982 | Canada | 2/425 |
| 134183 | 3/1985 | European Pat. Off. | 2/410 |

*Primary Examiner*—C. D. Crowder
*Assistant Examiner*—Michael A. Neas
*Attorney, Agent, or Firm*—Joseph W. Molasky & Associates

[57] ABSTRACT

The disclosure herein describes a face guard for a sports headgear that comprises a face shield and a chin contacting element hingedly mounted to the lower part of the face shield, inwardly thereof. In one embodiment, the chin contacting element is pivotally mounted within a chin frame which is, itself, hingedly connected to the face shield, wherein the downward movement of the chin frame is limited by its upper edge contacting the lower edge of the face shield.

8 Claims, 4 Drawing Sheets

FACE SHIELD WITH CHIN CONTACTING ELEMENT

FIELD OF THE INVENTION

The present invention relates to a face shield for use with a sports headgear equipped with a chin contacting element.

BACKGROUND OF THE INVENTION

At present, face guards for sports headgear, such as football or hockey helmets, consist of a shield which can be either of the grill type, consisting of metallic bars, or of the visor type wherein a transparent plastic member extends at least over the viewing portion of the face guard.

In football, a strap extends from both sides of the helmet and supports an intermediate chin contacting element. The strap, when secured to the helmet by means of snaps, serves to tightly maintain the helmet to the head of the wearer. In hockey, there is usually a loose strap extending under the player's chin, the strap being secured again to opposite side snaps on the helmet. In both sports, it has been found that the strap is cumbersome. In football, for example, very often the strap must be unsnapped after each play in order to release the pressure exerted on the player's head. In hockey, the strap must be maintained loose in order to enable the player to remove his helmet for cooling.

OBJECTS AND STATEMENT OF THE INVENTION

An object of the present invention is to overcome the above problems with presently used sports face guards. This is achieved by providing a face guard with a shield equipped with a chin contacting element mounted to the face shield instead of being secured to the helmet by snaps or other attachment means.

It is another object of the present invention to hingedly connect the chin element to the face shield thus allowing the device to follow the jaw movements of the user.

In one embodiment of the present invention, the face guard comprises a face shield defining an arc-shaped body having a front viewing section and opposite side sections, the side sections being adapted for mounting to a helmet forming part of the sports headgear;

a chin device defining an arc-shaped rigid frame hingedly mounted at a lower part of and within the arc-shaped body, the frame defining a central region and opposite side regions, the side regions being pivotally connected to the side sections of the face shield;

a chin contacting element mounted to the central region of the frame; and means limiting downward pivotal movement of the frame.

In one form of this embodiment of the invention, the downward limiting movement of the frame is accomplished by having the upper edge of the frame contacting the lower edge of the face shield.

In another form, the chin contacting element is pivotally connected to the frame of the chin device.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
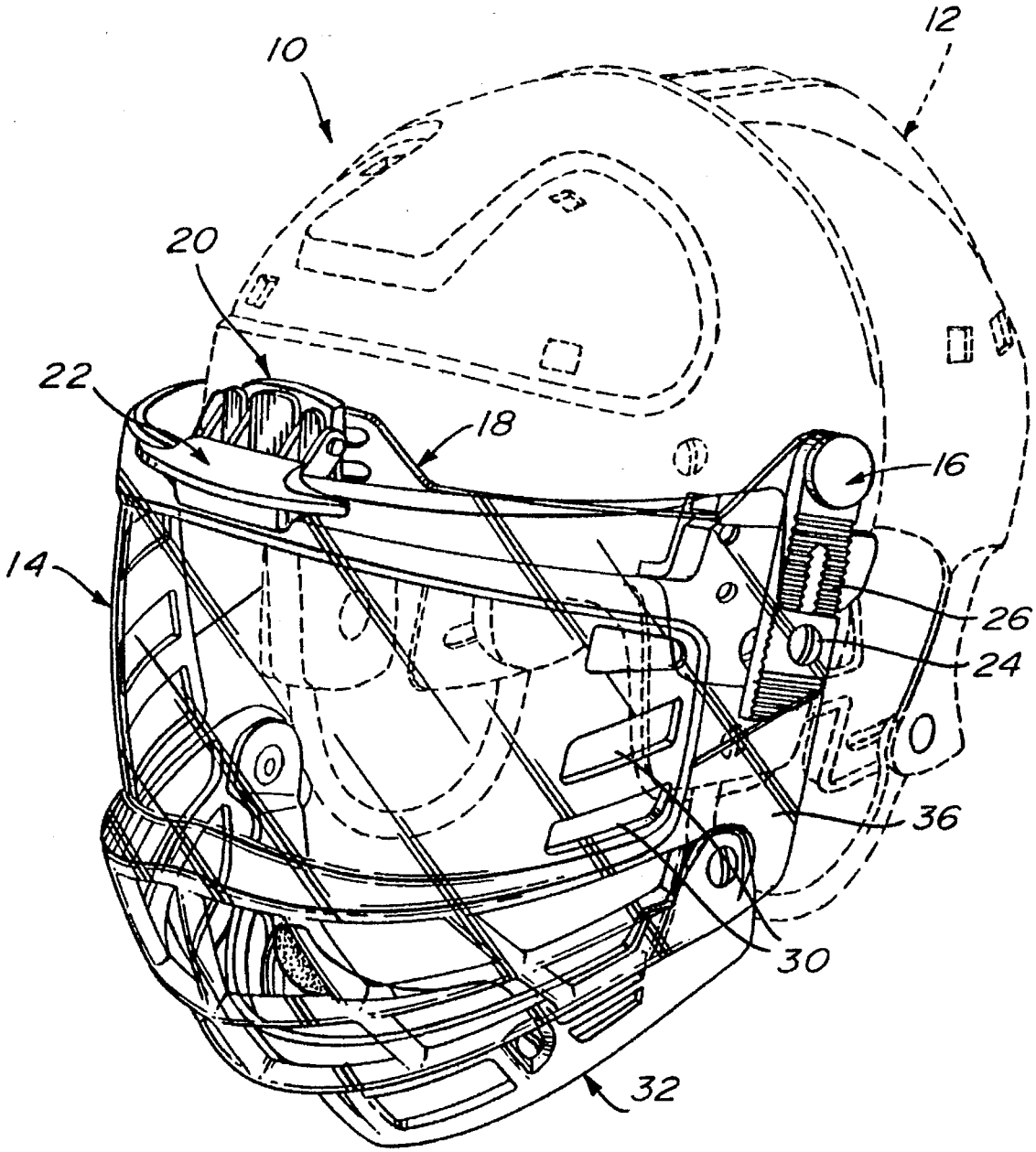
FIG. 1 is a perspective view of one embodiment of a face guard made in accordance with the present invention.
Figure 2:
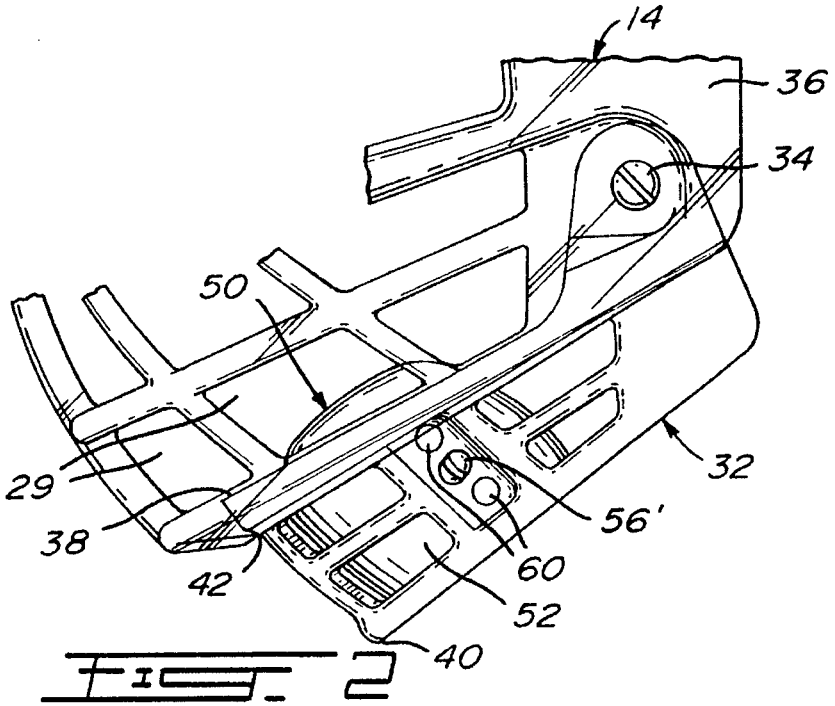
FIG. 2 is an enlarged side elevation view of the chin device mounted to the lower part of the face shield, partially shown.
Figure 3:
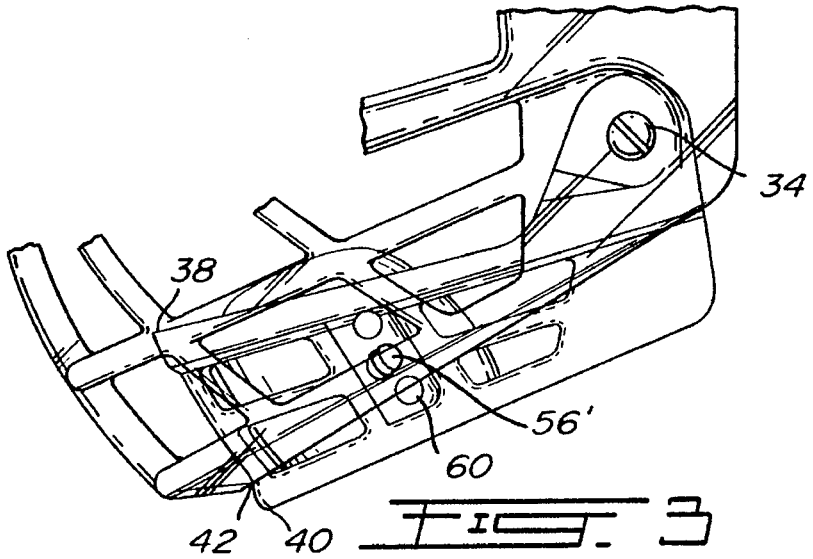
FIG. 3 is a view similar to that of FIG. 2 showing another position of the chin frame.

Referring to FIG. 1, there is shown a first embodiment of a sport headgear, generally denoted 10, consisting of a helmet 12 and of a face guard 14, the latter being hingedly connected to the helmet at opposite sides thereof through appropriate hinge elements 16. These elements are mounted for pivotal movement to an adapter 18 secured to the helmet and serving as an intermediate member between the helmet and the shield. Interlocking elements 20 and 22 respectively mounted to the adapter and to the face shield allow the face shield to be secured to the helmet; on the other hand, these interlocking elements are releasable to enable a manual disengagement whereby the face shield may be lifted outwardly over the helmet. The particular construction of this face shield and its interconnection with the helmet is described in a co-pending application filed concurrently herewith.

The face guard 14 consists in the present embodiment of a transparent arc-shaped body made of plastics material and having an upper part defining a central viewing section and opposite side sections. The side sections are secured by fastening elements 24 received in a slotted member 26 which serves to permit various positionings of the face guard relative to the helmet.

The lower part of the face shield has a grill type structure with a series of openings 29 allowing for ventilation. Similar openings 30 are provided on each side section of the transparent body to also provide ventilation to the user.

Referring to FIGS. 2 to 6, a chin device 32 in the shape of an arc-shaped rigid frame has a pair of opposite side wings 32*a*, 32*b* which are pivotally connected by appropriate fastening hinge elements 34 to the sides 36 of the face shield 14. Preferably, the common axis extending through both hinges 34 coincides with the pivotal axis of a human jaw. However the position of this axis may vary, as described in the above-mentioned co-pending application, to conform with the varying face configurations of users; this is achieved by manipulating and adjusting the fastening elements 24 on each side of the face shield.

Figure 4:
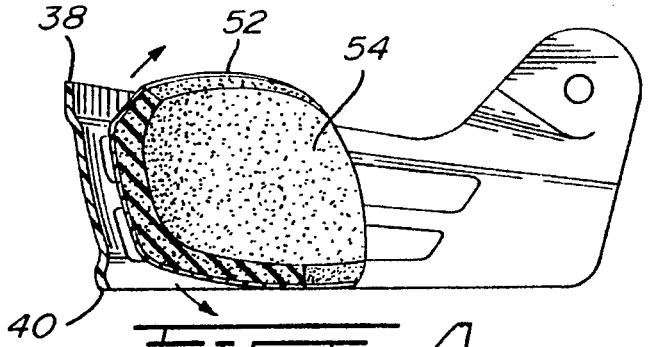
FIG. 4 is a cross-sectional view of the chin contacting element.

The arc-shaped rigid frame comprises an upper edge 38 and a lower edge 40 (see FIG. 4). The downward movement of the frame 32 is limited by the upper edge 38 of the frame when contacting the lower edge 42 of the face shield 14.

Figure 5:
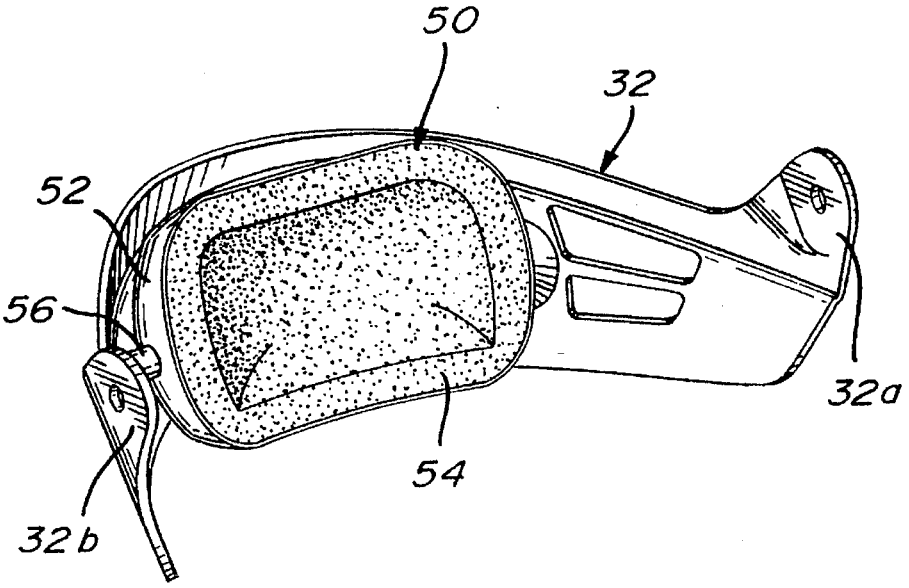
FIG. 5 is a perspective view of the chin device.
Figure 6:
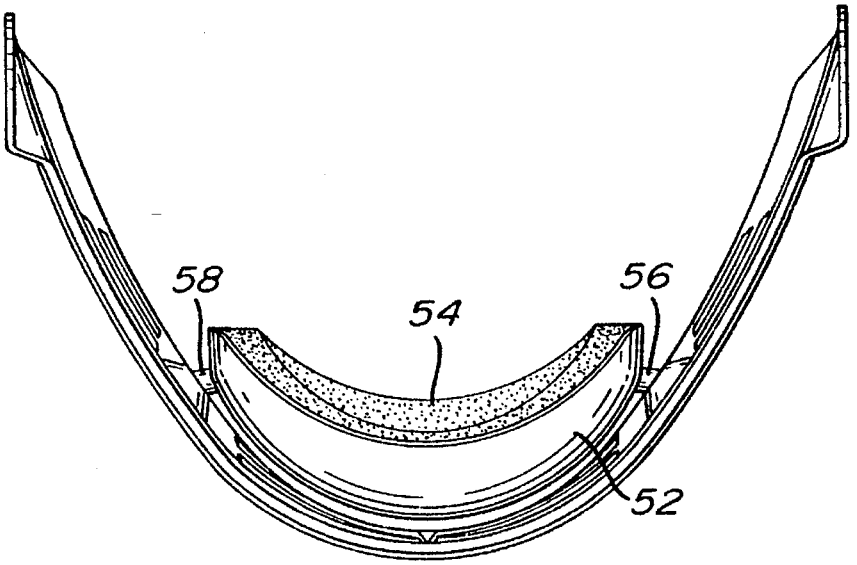
FIG. 6 is a top plan view thereof.

As illustrated in FIGS. 4, 5 and 6, a chin contacting element 50 is mounted in the front central region of the frame 32. This element comprises a rigid outer shell 52 and an inner chin contacting cushion element 54. Shell 52 is mounted to the frame in a manner that it can pivot relative to the frame about a pair of hinge elements 56 and 58. The hinges 56 and 58 each have a head portion (see 56' in FIG. 3) which can be snapped in and out of a series of vertically spaced openings 60 in the frame, again to provide comfortable positioning of the chin device on the chin of a user.

Hence, the chin contacting device has a double pivot adjustability with respect to the user's chin in that it pivots about the hinges 56 and 58 of the frame which, in turn, may pivot about the pivots 34 on each side of the frame.

Figure 7:
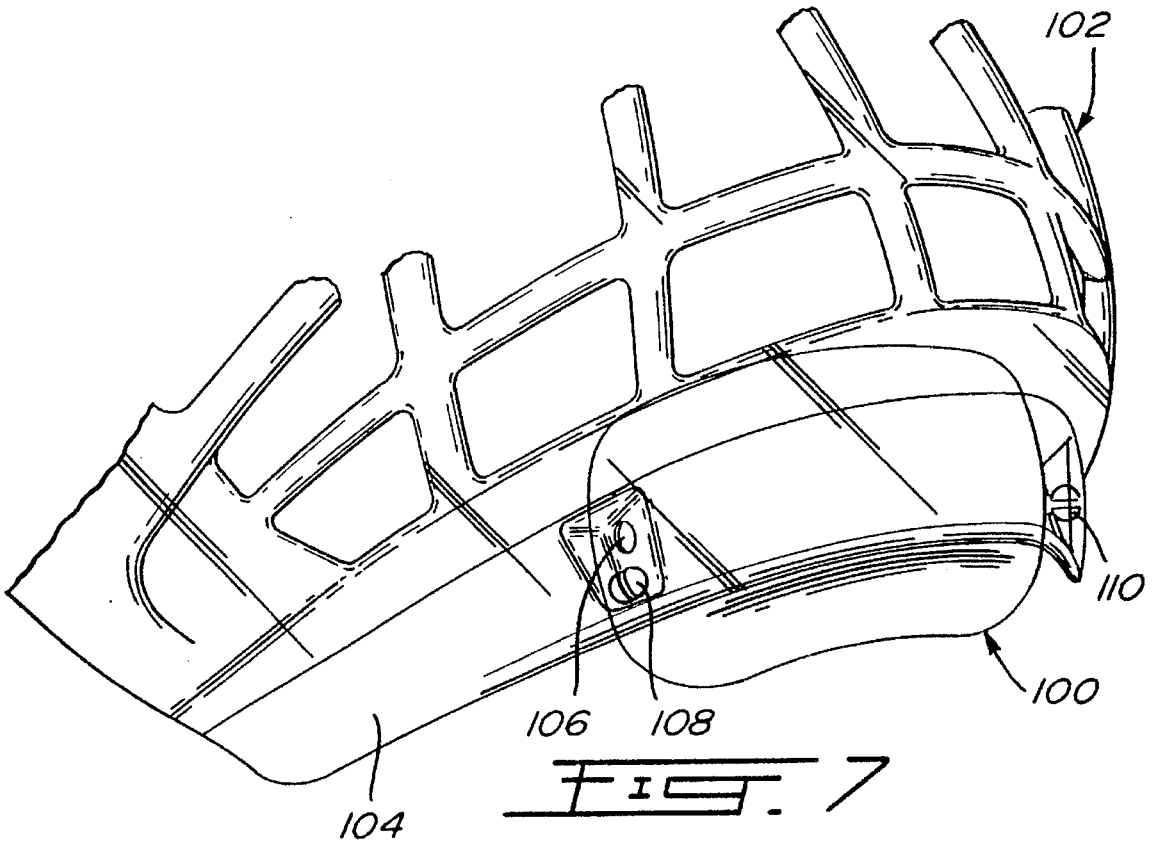
FIG. 7 is a bottom perspective view showing another embodiment of the present invention.
Figure 8:
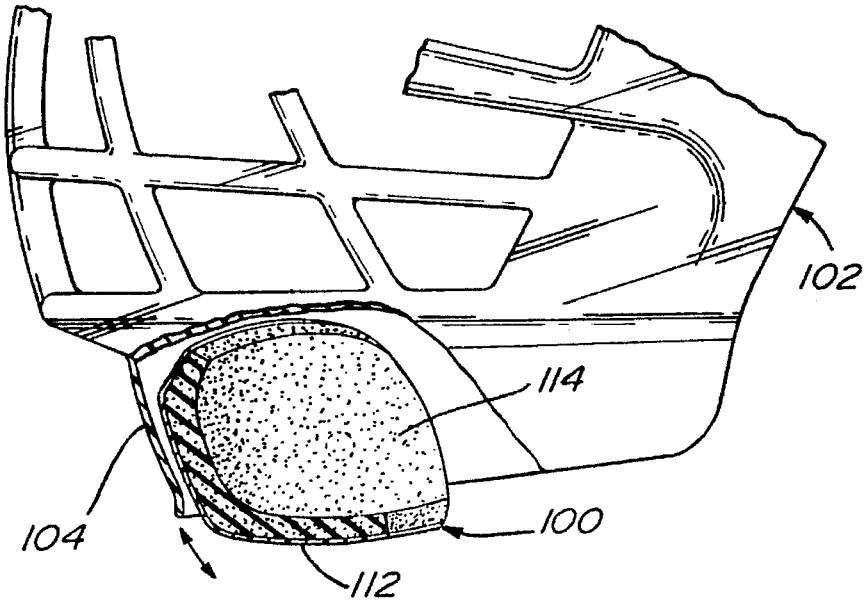
FIG. 8 is a cross-sectional view of the chin contacting element of FIG. 7.

FIGS. 7 and 8 show another embodiment of the present invention wherein a chin contacting device 100 is mounted directly to the lower part of a face shield 102. In this embodiment, the lower grill-like structure 104 of the face shield is provided with one or more openings 106 on opposite sides of the central region of the face shield so that the head of hinge elements 108, 110 may be snappily engaged therein. Again, an adjustment is possible by properly locating the hinge elements in the desired opening. These hinge elements are fixed to the rigid outer shell 112 of the chin device which also includes an inner cup-shaped cushion element 114.

Although the invention has been described above with respect to two specific forms, it will be evident to a person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A face guard for a sports headgear comprising:

a face shield defining an arc-shaped body having a front viewing section and opposite side sections, said side sections being adapted for mounting to a helmet forming part of the sports headgear, said face shield body having a lower part defining a lower peripheral edge;

a chin device defining an arc-shaped rigid frame hingedly mounted at a lower part of and within said arc-shaped body of said face shield; said frame defining a central region and opposite side regions, said side regions being pivotally connected to said side sections of said face shield; said frame of said chin device defining an upper peripheral edge;

a chin contacting element mounted to said central region of said frame; and means limiting downward pivotal movement of said frame;

said limiting means consisting of said upper peripheral edge and of said lower peripheral edge when contacting one another on downward movement thereof.

2. A face guard as defined in claim 1, wherein said frame defines a grill structure.

3. A face guard as defined in claim 1, wherein said face shield is made of a transparent plastics material.

4. A face guard as defined in claim 3, wherein said viewing section of said face shield includes a series of side openings for ventilation.

5. A face guard as defined in claim 3, wherein said lower part of said face shield defines a grill structure including ventilation openings.

6. A face guard for a sports headgear comprising:

a face shield defining an arc-shaped body having a front viewing section and opposite side sections, said side sections being adapted for mounting to a helmet forming part of the sports headgear;

a chin device defining an arc-shaped rigid frame hingedly mounted at a lower part of and within said arc-shaped body of said face shield; said frame defining a central region and opposite side regions, said side regions being pivotally connected to said side sections of said face shield;

a chin contacting element hingedly mounted to said central region of said frame; and means limiting downward pivotal movement of said frame.

7. A face guard as defined in claim 6, wherein said chin contacting element is cup-shaped with opposite sides thereof pivotally connected to said frame.

8. A face guard as defined in claim 6, wherein said chin contacting element consists of an outer rigid shell and of an inner cushion material.

* * * * *